US007161548B2

(12) United States Patent
Tsukamoto

(10) Patent No.: US 7,161,548 B2
(45) Date of Patent: Jan. 9, 2007

(54) WIRELESS COMMUNICATION APPARATUS

(75) Inventor: Sotaro Tsukamoto, Aichi (JP)

(73) Assignee: Sony Corporation (JP)

( * ) Notice: Subject to any disclaimer, the term of this patent is extended or adjusted under 35 U.S.C. 154(b) by 45 days.

(21) Appl. No.: 10/926,315

(22) Filed: Aug. 26, 2004

(65) Prior Publication Data

US 2005/0052329 A1 Mar. 10, 2005

(30) Foreign Application Priority Data

Sep. 9, 2003 (JP) ..... P2003-317122

(51) Int. Cl.
*H01Q 13/03* (2006.01)
*H01Q 1/24* (2006.01)

(52) U.S. Cl. ..... 343/767; 343/702

(58) Field of Classification Search ..... 343/767, 343/702, 700 MS, 771
See application file for complete search history.

(56) References Cited

U.S. PATENT DOCUMENTS 2,559,693 A * 7/1951 Willoughby ..... 343/731
4,723,305 A 2/1988 Phillips et al.
4,975,711 A 12/1990 Lee
5,914,693 A * 6/1999 Takei et al. ..... 343/767
6,150,989 A * 11/2000 Aubry ..... 343/767
6,307,520 B1 * 10/2001 Liu ..... 343/702
6,885,353 B1 * 4/2005 Kurihara ..... 343/860
6,906,674 B1 * 6/2005 McKinzie et al. ..... 343/767
2003/0112196 A1 6/2003 Wang et al.

FOREIGN PATENT DOCUMENTS

EP 0 851 530 A 7/1988
FR 2 771 552 A 5/1999
JP 2003-124738 4/2003

* cited by examiner

*Primary Examiner*—Hoanganh Le
(74) *Attorney, Agent, or Firm*—Rader, Fishman & Grauer PLLC; Ronald P. Kananen

(57) ABSTRACT

A wireless communication apparatus having a metal housing is provided, in which an outside antenna is not required and a small antenna the sensitivity of which does not decrease is included.

A slit 1 is provided on a metal housing 5 of a wireless communication apparatus and a feeder 2 is connected to a position approximately three-quarters of the long side of the slit 1 to be used as a ⅜λ slit antenna.

7 Claims, 4 Drawing Sheets

WIRELESS COMMUNICATION APPARATUS

BACKGROUND OF THE INVENTION

1. Field of the Invention

The present invention relates to a wireless communication apparatus including a slit antenna that is used for wireless communication.

2. Description of the Related Art

Wireless communication apparatuses such as a mobile telephone; a personal computer incorporating a mobile telephone, a Bluetooth®, a wireless LAN, a UWB (Ultra Wide Band) and others for performing the function of wireless communication; a PDA (Personal Digital Assistance); a digital still camera; a camcorder; consumer electric appliances and the like have been known. In those wireless communication apparatuses metals, such as magnesium (Mg), aluminum (Al) or other metals are used for a part or the whole of a housing in order to improve the strength thereof and to make outer appearance excellent in design. For performing the wireless communication function, an antenna is indispensable; however, the antenna may greatly lose the sensitivity thereof when located near metals or put into a metal-covered housing.

Therefore, conventionally, an antenna has been disposed outside a housing, or a part of the housing near the antenna has been made of plastics instead of metals in both the cases where the antenna was inside the housing and where the antenna was outside the housing.

However, placing an antenna outside the housing is not preferable in view of being an obstacle to achieving miniaturization of the apparatus. Also, when a part of the housing near an antenna is made of a plastic or the like instead of a metal, such problems as decreasing the strength of the housing and decreasing the degree of freedom in design may occur. Therefore, some deterioration in sensitivity may have been allowed in exchange for putting an antenna inside the housing.

In order to solve the above problems, there is known a slit antenna provided on the surface of a metal housing, which has the length equal to a half of a wave length ($\lambda/2$) of a receiving radio wave and which is covered by a high permeability member.

FIG. 1 is an explanatory view of an example of the structure of the above described slit antenna. The conventional slit antenna has a rectangular slit 21, the length of a long side LT of which is a half of a wave length ($\lambda/2$); and a feeder 22 is connected to a feeding point 23 and a ground point 24 provided at the center of the metal portion of the long side of the slit. As the feeder 22, conventionally, an unbalanced cable such as a coaxial cable is used. At that time, since the slit 21 functions similarly to a $\lambda/2$ dipole antenna, if the feeder 22 connected to the feeding point 23 is not made balanced, it is difficult to match an input impedance of the slit antenna 21 to the feeder 22, so that the antenna gain decreases. Therefore, through a balun 25 or the like, the unbalanced feeders 22*a* and 22*b* are required to convert to balanced lines 22*c* and 22*d*.

The above described slit antenna is disclosed in Patent document 1.

Patent document 1: Japanese Published Patent Application No. 2003-124738

However, the above-described slit antenna has become an obstacle to the design of a housing due to the length of an antenna that is $\lambda/2$ and too long. For example, in the case where the wave length of a receiving signal is 90 cm, given a contraction rate that is determined based on a relative permeability and a relative permittivity of the high-permeability member covering a slit is TR, the length LT of the slit becomes the length of 45 cm multiplied by the contraction rate TR. Therefore, it is difficult to install the slit antenna in wireless communication apparatuses, particularly, for portable use or of small size such as a mobile telephone unit and PDA, and also it becomes an obstacle to the miniaturization of a housing. Further, requiring a balun or the like to obtain antenna matching also becomes an obstacle to the miniaturization of a housing.

SUMMERY OF THE INVENTION

An object of the present invention is to provide a wireless communication apparatus having a metal housing, in which no outside antenna is required and a small antenna that does not decrease the communication sensitivity is included.

In order to solve the above-described problems, the present invention uses a slit provided on a metal housing of a wireless communication apparatus to function as a slit antenna in which a feeder is connected to the position at approximately three-quarters of the long side of the slit.

Accordingly, no outside antenna protruding from a housing of a wireless communication apparatus is required. Furthermore, since the length of a slit that is provided on the housing can be shorter than that of conventional ones, a wireless communication apparatus can be further miniaturized.

According to the present invention, since a metal housing of a wireless communication apparatus is used as a part of a slit antenna, no outside antenna is required, so that a wireless communication apparatus can be miniaturized easily.

Also, a balun or the like is conventionally necessary for antenna matching; however, according to the present invention, the communication sensitivity can be improved without adding a balun or the like.

Moreover, since the length of a slit can be shorter than that of conventional slit antennas, a slit antenna further small-sized than the conventional ones can be obtained and, therefore, can be easily applied to small-sized apparatuses such as a mobile wireless communication apparatus and others. Also, the degree of the freedom in design for the outer appearance can be enhanced.

DESCRIPTION OF THE PREFERRED EMBODIMENT

Hereinafter, embodiments of the present invention will be explained with reference to FIGS. 2 to 7.

It should be noted that as a wireless communication apparatus to which the present invention is applied, a mobile telephone unit, a PHS (Personal Handyphone System), a transceiver and a GPS (Global Positioning system) and others can be mentioned; and further, the present invention can be applied to other apparatuses: such as a personal computer originally not functioning as a wireless communication apparatus, incorporated with the wireless communication function such as a mobile telephone, Bluetooth®, a wireless LAN, and UWB, electronic equipment such as PDA, a digital still camera, a camcorder, consumer electric appliances and the like, and wireless broadcasting receivers such as a radio receiver, a television receiver, a DTV (digital television) and others. Hereupon, a so-called laptop computer having the wireless communication function (Bluetooth®, IEEE802. 11b wireless LAN, or the like) of ISM band (Industry Science Medical band: 2.4 GHz) will be explained as an example.

Figure 2:
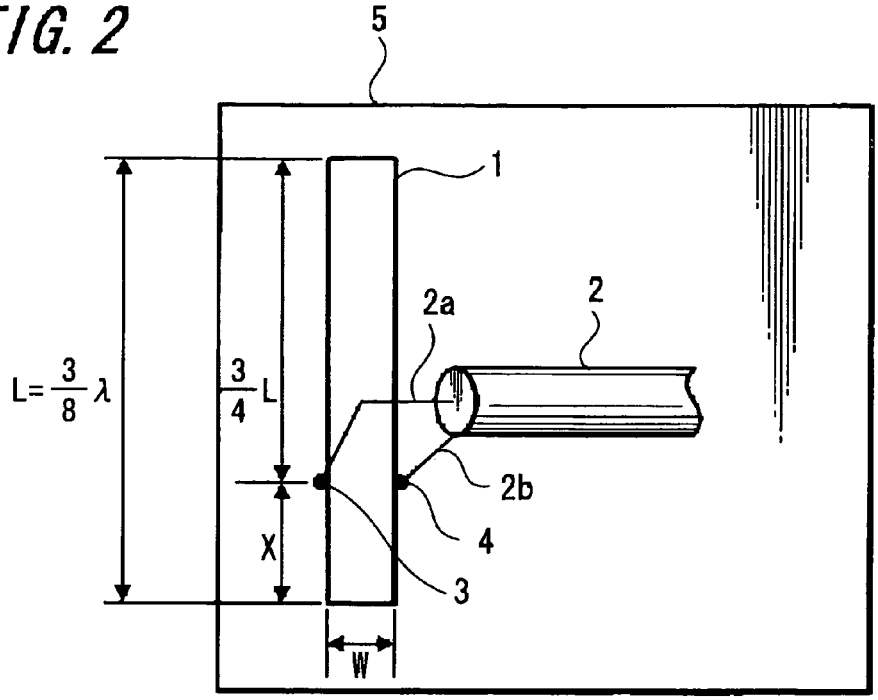
FIG. 2 is an explanatory view showing an example of a structure of an antenna device according to a first embodiment of the present invention.

FIG. 2 shows an example of a structure of an antenna device according to the first embodiment of the present invention. As shown in FIG. 2, to obtain the wireless communication function of ISM band (2.4 GHz), a rectangular slit (opening) 1 having the length of 46.9 mm that is equal to ⅜λ is provided in a metal plate 5 on the surface of a metal housing, and a feeder 2 is connected to a feeding point 3 located on the metal portion at the position approximately three-quarters of the long side L of the slit 1. The feeder 2 is connected to a transmitter or a receiver, which is not shown in a drawing and which is located inside the housing. As the feeder 2, an unbalanced transmission line may be used, and in this example, a coaxial cable is used. Hereupon, a core wire conductor of a signal line 2*a* of the coaxial cable is connected to a feeding point 3, and an external sheath conductor of a ground line 2*b* is connected to a ground point 4 located at the metal portion on the opposite side of the feeding point 3 located on the metal portion at the position approximately three-quarters of the long side of the slit 1. With the structure described above, the ⅜λ slit antenna can be obtained.

Figure 3:
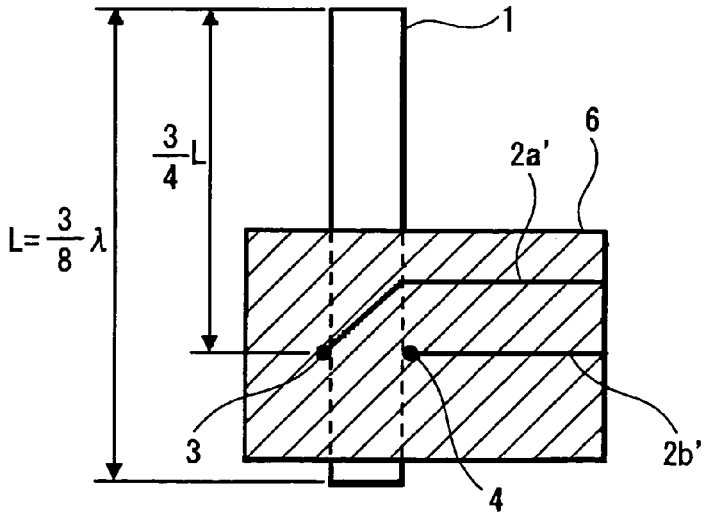
FIG. 3 is an explanatory view showing an example of a structure of an antenna device according to a second embodiment of the present invention.

FIG. 3 shows an example of a structure of an antenna device according to the second embodiment of the present invention. In FIG. 3, a rectangular slit (opening) 1 having the length of 46.9 mm that is equal to ⅜λ is also provided in the metal plate on the surface of the metal housing, and a feeder is connected to a feeding point 3 located on the metal portion at the position approximately three-quarters of the long side of the slit 1. In this example, a feeder is constructed using a microstrip line on a PCB (Printed Circuit Board) 6. The microstrip line is also an unbalanced transmission line, and here a transmission line 2*a*' of the microstrip line is connected to the feeding point 3, and a conduction portion 2*b*' constituting a ground plane is connected to a ground point 4.

Note that the width of the slit 1 explained in the first and second embodiments, namely, the width W of slit 1 shown in FIG. 2, can be adjusted in accordance of the band width to be used. The broader the width W becomes, the more declined a Q value of the slit resonance becomes, so that the frequency bandwidth that an antenna can receive and radiate becomes wide. Also, there is a case in which by the parasitic capacitor from adjacent parts to the slit 1, an optimum value of the length L of the slit 1 may somewhat deviate from ⅜λ. In that case, the length L is adjusted so that the VSWR (Voltage Standing Wave Ratio) and the efficiency of the slit antenna may be most improved. Particularly, the shorter length from the edge of the slit 1 to the position of the feed point 3, namely, the length of the part X equivalent to a quarter of the slit length L shown in FIG. 2, is adjusted.

Figure 1:
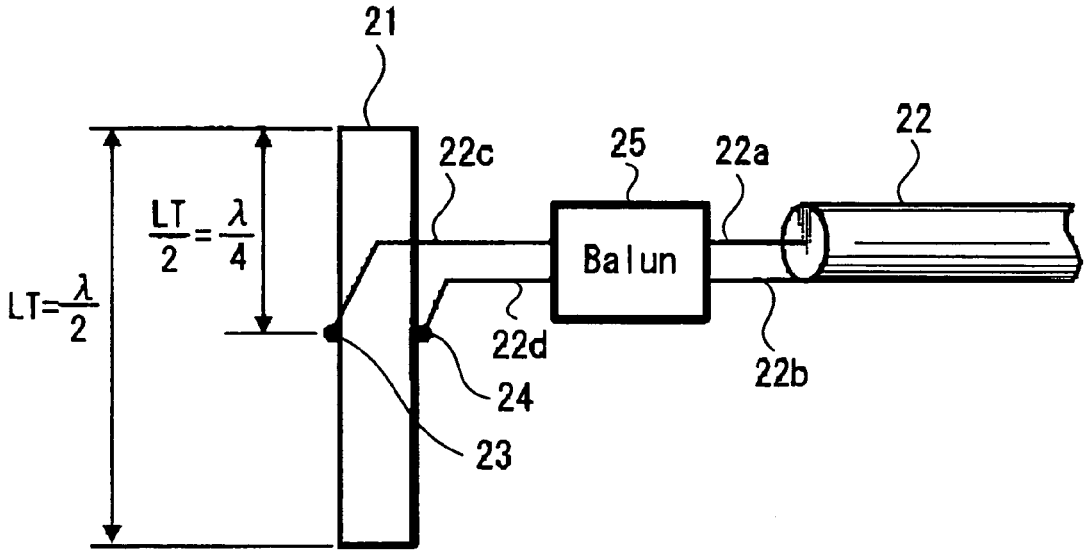
FIG. 1 (RELATED ART)
FIG. 1 is an explanatory view showing an example of a conventional antenna device.

In the case of a conventional slit antenna as shown in FIG. 1, the feeder 22 is connected to the center of the long side LT of the rectangular slit 21; and, at that time, the slit 21 functions similarly to a λ/2 dipole antenna. Specifically, the slit 21 needs to have the length LT of 62.5 mm equivalent to λ/2 to obtain the wireless communication function of ISM band (2.4 GHz band). However, the slit antenna according to the embodiments of the present invention functions as a ⅜λ slit antenna only requiring the length L of the slit 1 to be 46.9 mm, which is shorter than the conventional slit antenna.

Also, since a conventional λ/2 slit antenna functions as a dipole antenna, it is difficult to match an input impedance of a slit antenna to a feeder without converting the feeder into a balanced line through a balun or the like, and therefore antenna gain decreases. On the other hand, since a ⅜λ slit antenna according to the embodiments of the present invention functions approximately as a monopole antenna, a feeder 2 may be a conventional unbalanced transmission line such as a coaxial cable, a microstrip line, a coplaner wave guide and others, as described above. Accordingly, a balun or the like, which has conventionally been needed, becomes unnecessary and an internal circuit of an antenna can be simplified to make the miniaturization of the apparatus easy.

Figure 4:
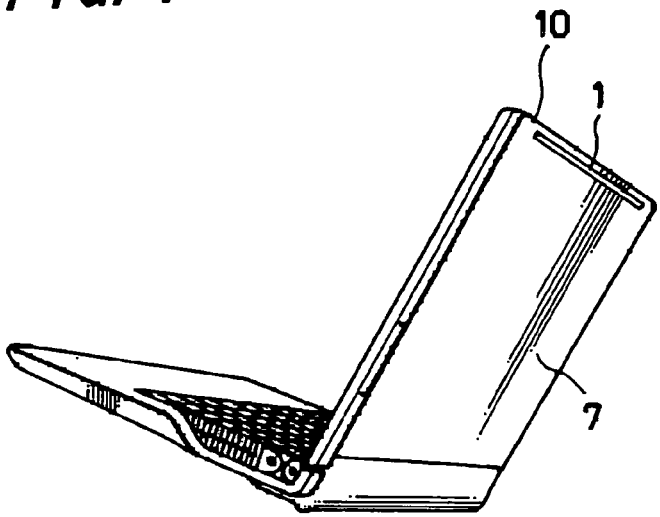
FIG. 4 is an explanatory view showing an example to which an antenna device according to the embodiments of the present invention is applied.

FIG. 4 shows an example in which an antenna device according to the first or second embodiment of the present invention is applied to a laptop-type personal computer. A personal computer 10 includes a housing 7 made of magnesium. A rectangular slit 1 that is formed in a thin straight-line shape is provided at a position along the long side of the edge portion of a lid of the magnesium housing 7 to function as a slit antenna. It should be noted that the position of the slit 1 is not limited to this example, and the slit 1 can be provided at any position on the housing 7 made of magnesium as long as the length of the slit is secured.

Figure 5:
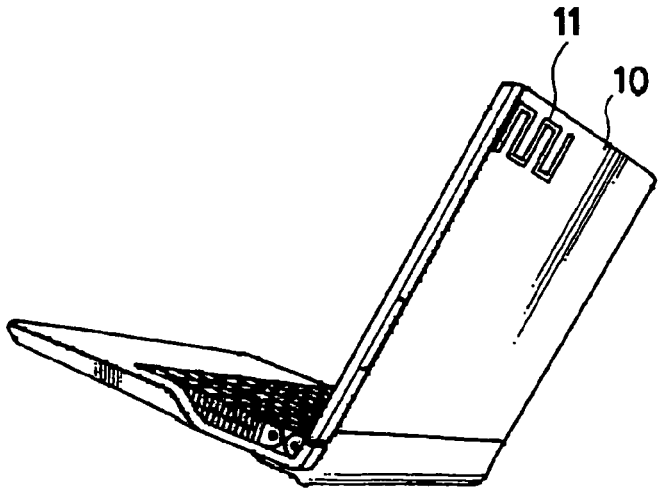
FIG. 5 is an explanatory view showing another example to which an antenna device according to the embodiments of the present invention is applied.

Further, although in this example the slit has a straight line shape, it is also possible to make a slit 11 curved in a meandered line shape having a plurality of bending points as shown in FIG. 5 or to make the slit in a curved or waved shape. Accordingly, with respect to the slit according to this example, a position where the slit is formed and the form thereof can be selected arbitrarily, so that there may be little influence on the outer appearance in design and the like of the apparatus.

Figure 6:
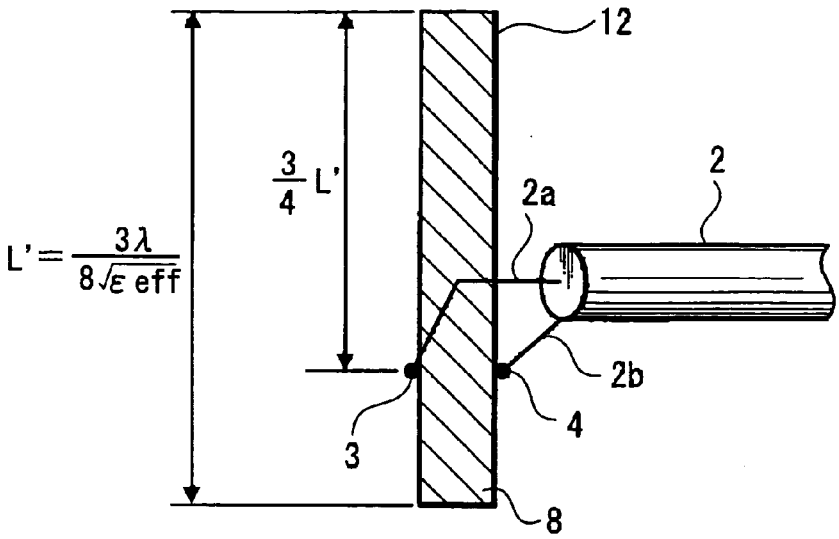
FIG. 6 is an explanatory view showing an example of a structure of an antenna device according to a third embodiment of the present invention.

Next, an example of a structure of an antenna device according to the third embodiment of the present invention is shown in FIG. 6. In FIG. 6, a slit 12 is provided in the metal plate on the surface of a metal housing, and a feeder 2 is connected to a feeding point 3 located on the metal portion at the position approximately ¾ of the long side L' of the slit 12. Further, the opening of the slit 12 is filled with a dielectric material 8, such as plastics or others. Accordingly, as shown in the following Formula 1, by filling the opening of slit 12 with the dielectric material 8, the length L' of the slit can be made short depending upon the value of an effective relative dielectric coefficient of this slit 12.

$$L' = \frac{3\lambda}{8\sqrt{\varepsilon eff}} \quad \text{[Formula 1]}$$

For example, when the slit 12 is filled with ABS (Acrylonitrile Butadiene styrene) resin, and in the case where an effective dielectric coefficient of the slit portion is $\in eff=4$, the length L' of the slit 12 becomes ½ of the length 46.9 mm of the slit explained in the first embodiment to be 23.4 mm.

As described above, according to the third embodiment of the present invention, the length of the slit provided on the metal surface of the housing can be further shortened by the effect of the dielectric material with which the opening of the slit is filled.

Figure 7:
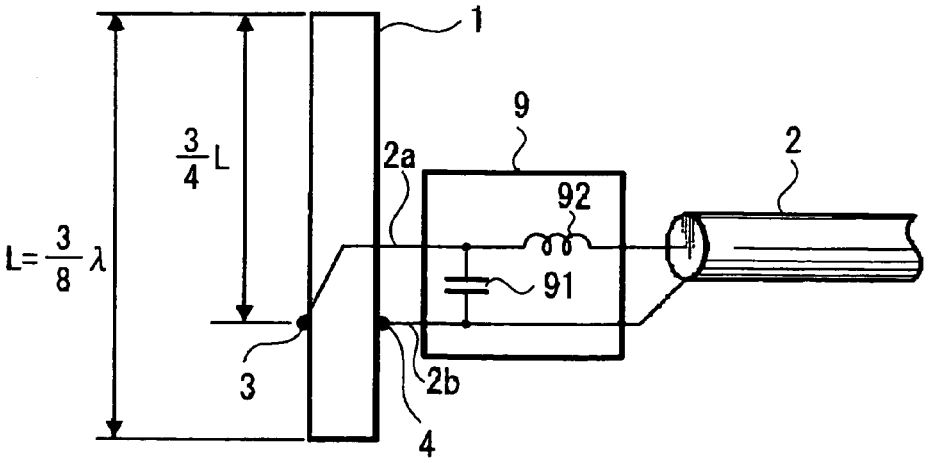
FIG. 7 is an explanatory view showing an example of a structure of an antenna device according to a fourth embodiment of the present invention.

Next, an example of a structure of an antenna device according to the fourth embodiment of the present invention is shown in FIG. 7. With respect to input impedance matching of a slit antenna, there is an explanation in the first embodiment that impedance matching can be achieved by adjusting the length $L=\frac{3}{8}\lambda$ of the long side of the slit 1 shown in FIG. 2; however, it is also possible by providing a matching circuit instead of adjusting the length thereof. In FIG. 7, a slit 1 is provided in a metal plate on the surface of a metal housing, and a feeder 2 is connected to a feeding point 3 located on the metal portion at the position approximately ¾ of the long side L of the slit 1. To each of input terminals of a signal line 2*a* and a ground line 2*b* of the feeder 2, a matching circuit 9 including a capacitor 91 and a coil 92 or a matching circuit 9 including a resonator electrically equivalent to those is connected. The input impedance of the slit antenna can be matched by the matching circuit 9 without adjusting the length L of the slit 1. Note that a balun for antenna matching is unnecessary even in this case.

As described above, according to the embodiments of the present invention, a metal housing of a wireless communication apparatus can be used as a part of a slit antenna, and the length of the slit provided on the housing can be sufficiently short to the extent of not causing problems in design and the strength of a housing.

Further, according to the embodiments of the present invention, no matching circuit for antenna matching is required, or even if a matching circuit is provided, no balun is required; so that the influence on the circuit layout inside the housing can be made small and miniaturization of the apparatus can be achieved.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

The invention claimed is:

1. A wireless communication apparatus comprising:

a metal housing having a rectangular slit on the surface thereof;

a feeder comprising an unbalanced transmission line connected to the position approximately three-quarters of the long side of said rectangular slit; and a transmitter and/or a receiver connected to said feeder, wherein said slit is made to function as an antenna device, and wherein a length of the slit is equal to a function of $\frac{3}{8}\lambda$ and a value of an effective relative dielectric coefficient of the slit, such that the length of the slit is shortened depending upon the value of the effective relative dielectric coefficient of the slit.

2. A wireless communication apparatus according to claim 1, wherein said feeder is composed of a microstrip line on a printed circuit board.

3. A wireless communication apparatus according to claim 1, wherein said slit is formed of a bent line having a plurality of bending points.

4. A wireless communication apparatus according to claim 1, wherein a matching circuit including a capacitor and a coil is connected to an input terminal of said feeder and the power is supplied through said matching circuit.

5. A wireless communication apparatus according to claim 1, wherein a matching circuit including a resonator which is electrically equivalent to a matching circuit including a capacitor and a coil is connected to an input terminal of said feeder and the power is supplied through said matching circuit.

6. A wireless communication apparatus according to claim 1, wherein said feeder comprises an unbalanced cable.

7. A wireless communication apparatus according to claim 1, wherein the length of the slit is equal to $\frac{3}{8}\lambda$ divided by the square root of the value of the effective relative dielectric coefficient of the slit.

* * * * *